US008113120B2

(12) United States Patent
Theurer et al.

(10) Patent No.: US 8,113,120 B2
(45) Date of Patent: Feb. 14, 2012

(54) TRACK POSITION CORRECTION MACHINE

(75) Inventors: Josef Theurer, Vienna (AT); Erwin Matzinger, Linz (AT)

(73) Assignee: Franz Plasser Bahnbaumaschinen-Industriegesellschaft m.b.H., Vienna (AT)

( * ) Notice: Subject to any disclaimer, the term of this patent is extended or adjusted under 35 U.S.C. 154(b) by 1362 days.

(21) Appl. No.: 11/728,011

(22) Filed: Mar. 23, 2007

(65) Prior Publication Data

US 2007/0199471 A1 Aug. 30, 2007

Related U.S. Application Data

(63) Continuation of application No. PCT/EP2005/009634, filed on Sep. 8, 2005.

(30) Foreign Application Priority Data

Oct. 1, 2004 (AT) ..... 1638/2004

(51) Int. Cl.
*E01B 29/05* (2006.01)

(52) U.S. Cl. ..... 104/2; 104/12

(58) Field of Classification Search ..... 104/2, 3, 104/4, 7.1, 7.2, 10, 11
See application file for complete search history.

(56) References Cited

U.S. PATENT DOCUMENTS

| | | | | |
|---|---|---|---|---|
| 5,619,929 | A * | 4/1997 | Theurer | 104/12 |
| 5,640,909 | A * | 6/1997 | Theurer | 104/7.2 |
| 5,660,112 | A * | 8/1997 | Theurer | 104/2 |
| 5,937,763 | A * | 8/1999 | Theurer | 104/2 |
| 6,805,059 | B2 * | 10/2004 | Theurer et al. | 104/12 |
| 2001/0027732 | A1 * | 10/2001 | Theurer et al. | 104/12 |
| 2001/0050021 | A1 * | 12/2001 | Theurer et al. | 104/2 |
| 2001/0050022 | A1 * | 12/2001 | Theurer et al. | 104/2 |
| 2007/0199471 | A1 * | 8/2007 | Theurer et al. | 104/2 |

FOREIGN PATENT DOCUMENTS

| | | |
|---|---|---|
| EP | 0 731 217 | 9/1996 |
| EP | 0 952 254 | 10/1999 |
| GB | 2 146 374 | 4/1985 |

* cited by examiner

*Primary Examiner* — Joe Morano, IV
*Assistant Examiner* — Jason C Smith
(74) *Attorney, Agent, or Firm* — Collard & Roe, P.C.

(57) ABSTRACT

A track position correction machine includes a multi-part machine frame and a satellite frame associated with the machine frame. A first drive displaces the satellite frame relative to the machine frame. A first packing unit and a track lifting unit are disposed on the satellite frame. A stabilization unit is associated with the machine frame. A second packing unit is disposed between the satellite frame and the stabilization unit. A second drive displaces the second packing unit relative to the machine frame.

3 Claims, 2 Drawing Sheets

TRACK POSITION CORRECTION MACHINE

CROSS REFERENCE TO RELATED APPLICATIONS

Applicants claim priority under 35 U.S.C. §119 of AUSTRIAN Application No. AT A1638/2004 filed on Oct. 1, 2004. Applicants also claim priority under 35 U.S.C. §120 of International Application No. PCT/EP2005/009634 filed on Sep. 8, 2005. This application is a by-pass continuation application of said International Application No. PCT/EP2005/009634 filed on Sep. 8, 2005. The International application under PCT Article 21(2) was not published in English. The disclosures of the aforementioned International application and Austrian application are incorporated by reference herein.

BACKGROUND OF THE INVENTION

1. Field of the Invention

The invention relates to a track position correction machine. More particularly, the invention relates to a track position correction machine comprising a multi-part machine frame having a satellite frame associated therewith. A first packing unit and a track lifting unit are disposed on the satellite frame, which can be displaced relative to the machine frame using a drive. A stabilization unit is associated with the machine frame and a second packing unit is disposed between the satellite frame and the stabilization unit.

2. The Prior Art

GB 2 146 374 shows a track position correction machine which travels continuously during work operation, while a satellite frame with a packing unit is moved discontinuously from packing site to packing site. After underfilling has taken place, the track is lowered in a controlled manner using a stabilization unit.

SUMMARY OF THE INVENTION

The invention relates to a track position correction machine. In one aspect, the track position correction machine includes a multi-part machine frame with a satellite frame associated with the machine frame. A first drive is provided for displacing the satellite frame relative to the machine frame. A first packing unit and a track lifting unit are disposed on the satellite frame. A stabilization unit is associated with the machine frame and a second packing unit is disposed between the satellite frame and the stabilization unit. A second drive is provided for displacing the second packing unit relative to the machine frame.

In a further aspect, the multi-part machine frame includes a first frame part, a second frame part following the first frame part, and a third frame part following the second frame part. The first packing unit is associated with the first frame part, the second packing unit is associated with the second frame part and the stabilization unit is associated with the third frame part.

In a further aspect, the track position correction machine includes a unit frame connected with the second packing unit. The unit frame has a front end and a back end and the second frame part includes two carrier frames running parallel to one another in a longitudinal machine direction. The unit frame is disposed centered between the two carrier frames. The unit frame is mounted at its front end to travel on the two carrier frames by way of a support roller and to be displaceable relative to the carrier frames at its back end.

In a further aspect, the track position correction machine includes a drive connected with the unit frame. The drive includes a press-down roller for contacting an underside of the second frame part which is spaced apart from the support roller in a vertical direction.

A track position correction machine according to an embodiment of the invention provides better underfilling of tracks having irregular distances between ties. In particular, with a track position correction machine according to an embodiment of the invention, it is possible to carry out a first packing, in combination with a track position correction, and subsequent further underfilling, during which the track position is no longer changed, within the framework of a continuous advance of the machine. Directly afterwards, the underfilled track can be immediately lowered by means of stabilization units, in controlled manner, and thereby brought into a permanent position.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE DRAWINGS

Figure 1:
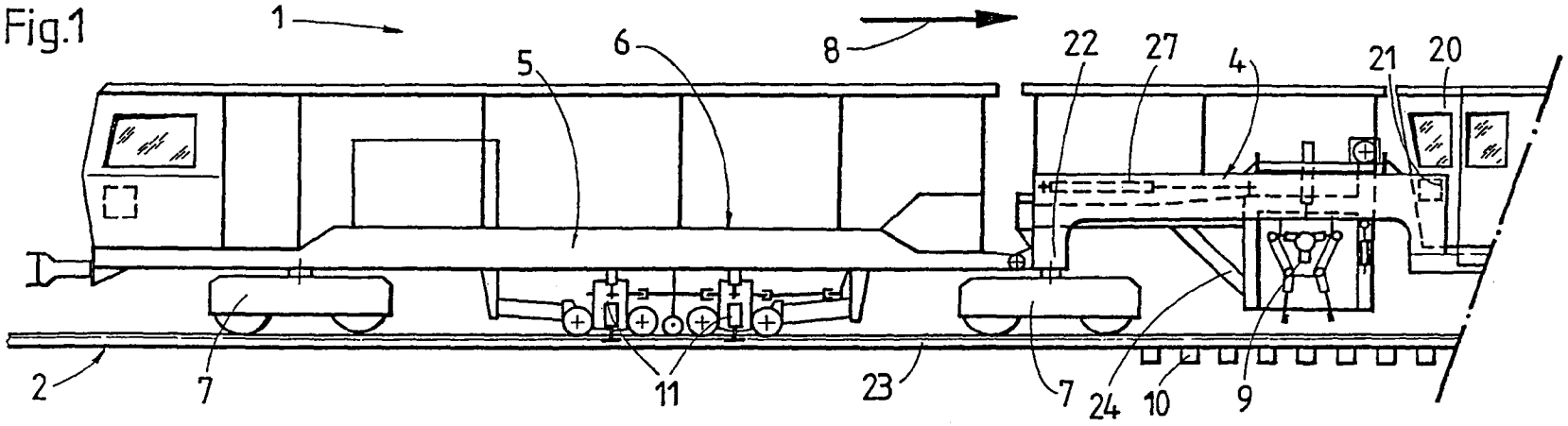
FIG. 1 shows a side view of a front segment of a track position correction machine according to an embodiment of the invention.
Figure 2:
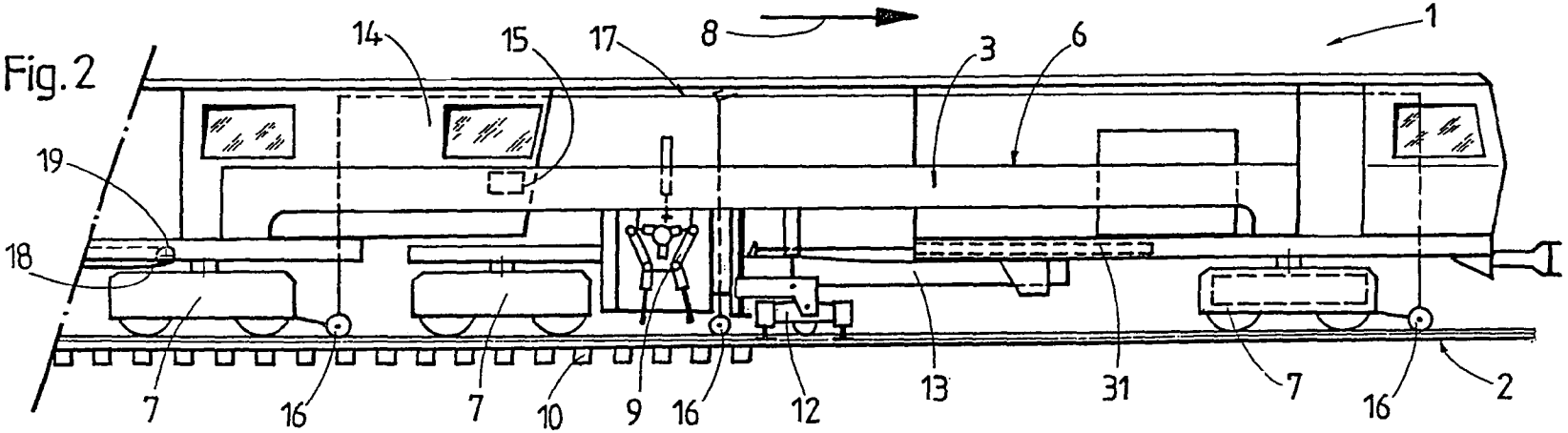
FIG. 2 shows a side view of a back segment of a track position correction machine according to an embodiment of the invention.

Referring now in detail to the drawings, FIGS. 1 and 2 show a machine 1 for correcting the position of a track 2. Machine 1 includes a machine frame 6 which may be composed of three frame parts 3, 4, 5, as well as rail undercarriages 7.

Front frame part 3 and center frame part 4 (with regard to a working direction 8) each have a packing unit 9 for underfilling ties 10. A back frame part 5 has stabilization units 11 associated with it.

A first packing unit 9 positioned on front frame part 3 is disposed on a satellite frame 13, together with a track lifting unit 12 that is positioned in front of it. The satellite frame is mounted on frame part 3 with a front end, so that it can be displaced lengthwise by means of a drive 31, while a back end is supported on its own rail undercarriage 7.

A first working cabin 14 is disposed above rail undercarriage 7. Working cabin 14 has a control device 15, connected with the front frame part 3. A reference system 17 having measurement axles 16 is provided for track position correction.

Center frame part 4 is connected with the front frame part 3 with an articulated connection 19, by way of a front end 18. A second working cabin 20 having a control device 21 is provided between this articulated connection 19 and the second packing unit 9. A back end 22 of the center frame part 4 rests on a rail undercarriage 7.

Figure 4:
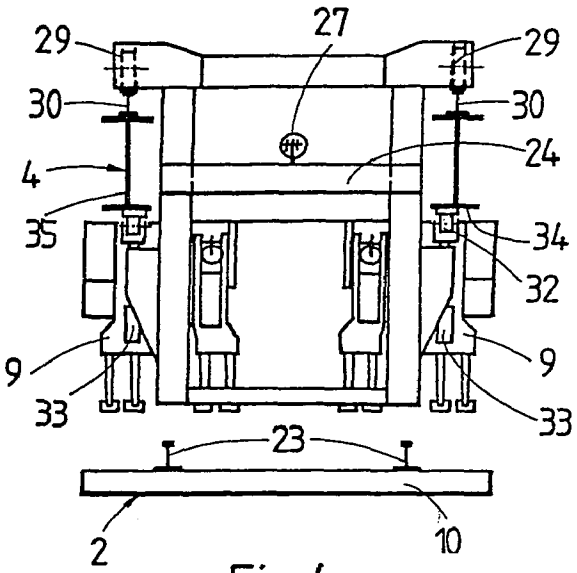
FIG. 4 shows a front view of the unit frame shown in FIG. 3.
Figure 3:
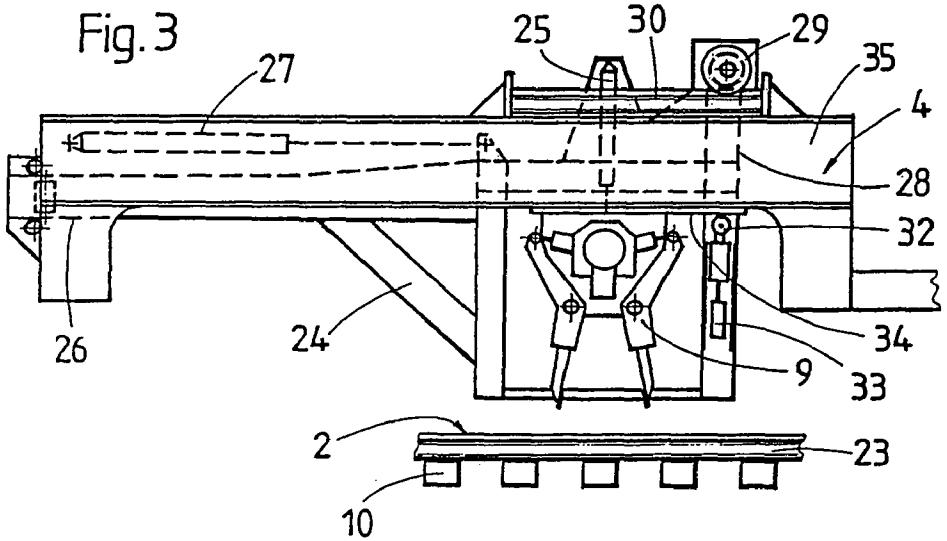
FIG. 3 shows a side view of a unit frame according to an embodiment of the invention.
Figure 5:
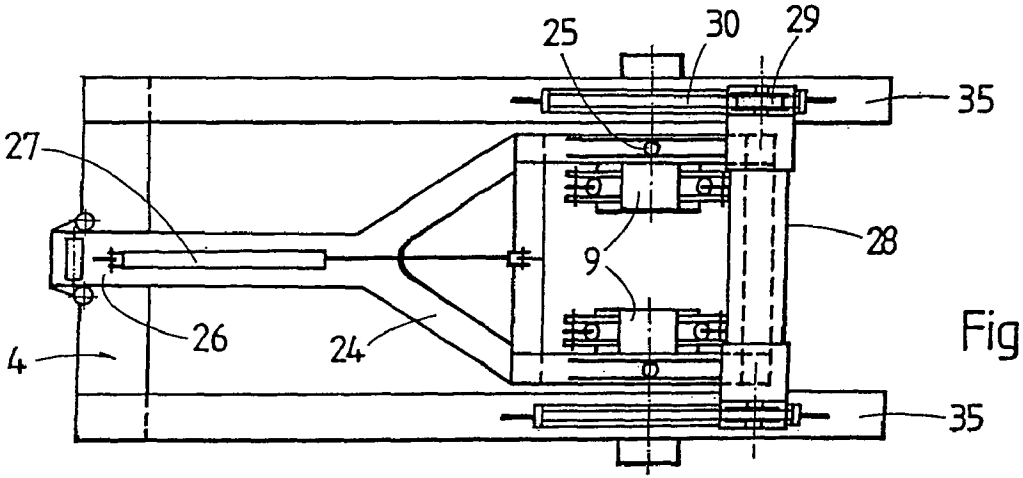
FIG. 5 shows a top view of the unit frame shown in FIGS. 3 and 4.

As shown in FIGS. 3, 4, and 5, two packing units 9 assigned to one rail 23, in each instance, may be mounted on a common unit frame 24, so as to be adjustable in height by means of drives 25. The unit frame 24 is displaceably mounted on center frame part 4 with a back end 26, and is displaceable relative to this frame part, in the longitudinal machine direction, by means of a drive 27. A front end 28 of the unit frame 24 is positioned between two carrier frames 35 that run in the longitudinal machine direction and has two support rollers 29 that can roll on guide rails 30.

Unit frame 24 has two drives 33, each drive having a press-down roller 32. The drives press the press-down rollers 32 against an underside 34 of frame part 4.

In operation, machine 1 is continuously moved in a working direction 8, for track position correction. Only the satellite frame 13 and the unit frame 24 are moved forward cyclically, or brought to a stop for local underfilling, with appropriate application of power to the respective drives 31, 27. The first packing unit 9 at the front frame part 3 underfills every other tie, while at the same time, the track 2 is brought into its correct position by means of the interaction of reference system 17 and track lifting unit 12. This first partial underfilling is controlled by a first operator located in the working cabin 14.

Every other tie that has not yet been underfilled is underfilled by the second packing unit 9 on the center frame part 4. This action is controlled by a second operator located in the working cabin 20. This packing procedure is carried out while maintaining the track position that has already been corrected, without any change. In this connection, it is particularly advantageous if the distance between the two rail undercarriages 7 that are adjacent to the back packing unit 9 is as small as possible. These undercarriages exert a pressure on the track 2 that has already been corrected, and thereby prevent it from being lifted up due to the underfilling. Furthermore, a crosswise displacement of the packing units in the curved track is eliminated.

Once the track 2 has been completely underfilled by the second packing unit 9, the track 2 is immediately lowered in a controlled manner using the stabilization units 11 which immediately follow, thereby stabilizing the track.

Accordingly, while several embodiments of the present invention have been shown and described, it is obvious that many changes and modifications may be made thereunto without departing from the spirit and scope of the invention.

What is claimed is:

1. A track position correction machine comprising:

a) a multi-part machine frame comprising a first frame part, a second frame part following said first frame part, and a third frame part following said second frame part;

b) a satellite frame associated with said machine frame;

c) a first drive for displacing said satellite frame relative to said machine frame;

d) a first packing unit associated with said first frame part and disposed on said satellite frame;

e) a track lifting unit disposed on said satellite frame;

f) a stabilization unit associated with said third frame part;

g) a second packing unit associated with said second frame part and disposed between said satellite frame and said stabilization unit; and h) a second drive for displacing said second packing unit relative to said machine frame.

2. The track position correction machine according to claim 1, further comprising a unit frame connected with the second packing unit, said unit frame having a front end and a back end, wherein said second frame part comprises two carrier frames running parallel to one another in a longitudinal machine direction and said unit frame is disposed centered between said two carrier frames and wherein said unit frame is mounted at said front end to travel on said two carrier frames by way of a support roller and is displaceable relative to said carrier frames at said back end.

3. The track position correction machine according to claim 2, further comprising a drive connected with said unit frame, said drive comprising a press-down roller for contacting an underside of said second frame part, said underside being spaced apart from said support roller in a vertical direction.

* * * * *